United States Patent [19]

Shadley

[11] Patent Number: 4,744,127

[45] Date of Patent: May 17, 1988

[54] DOOR HINGE

[75] Inventor: Cami L. Shadley, Jackson, Mich.

[73] Assignee: ITT Corporation, New York, N.Y.

[21] Appl. No.: 895,046

[22] Filed: Aug. 11, 1986

[51] Int. Cl.[4] ..... E05D 15/50; E05D 3/08

[52] U.S. Cl. ..... 16/232; 16/287; 16/302; 16/341

[58] Field of Search ..... 16/232, 287, 302, 341, 16/366; 296/146

[56] References Cited

U.S. PATENT DOCUMENTS

| | | | |
|---|---|---|---|
| 2,138,523 | 11/1938 | Haberstump | 296/146 |
| 3,150,408 | 9/1964 | Belsky | 16/366 |
| 3,470,579 | 10/1969 | Cencioni | 16/360 |
| 4,389,748 | 6/1983 | Grossman | 16/302 |
| 4,655,499 | 4/1987 | Piper | 16/232 |

*Primary Examiner*—Nicholas P. Godici

*Assistant Examiner*—Richard K. Seidel

*Attorney, Agent, or Firm*—James B. Raden; Robert P. Seitter

[57] ABSTRACT

A door hinge is disclosed including a door mounting bracket and a body mounting bracket interconnected by an intermediate member pivotably attached to each bracket. A locking arrangement including a pivotable locking arm on the intermediate member simultaneously locks and unlocks the intermediate member with the respective mounting bracket at the closed and an intermediate open position of the door providing for sequential, reversible pivotable movement of the intermediate member and door bracket as a unit about the pivot point on the body bracket between the closed and intermediate open position and independent reversible pivotable movement of the door mounting bracket between the intermediate open position and fully open position of the door.

9 Claims, 4 Drawing Sheets

DOOR HINGE

BACKGROUND OF THE INVENTION

This invention relates to door hinges. Although not limited thereto, the invention is particularly suited for use with a door in an automotive vehicle and in particular for use with a side door of a vehicle commonly referred to as a van. In these type of vehicles it is highly desirable to mount the door, and in particular the side cargo door, in a manner providing for maximun opening. Heretofore, typical pivotably mounted doors which open 180° have required externally exposed hinged parts such as a hinge pin in order that the door will be sufficiently laterally spaced from the side of the vehicle when fully opened. Exposed hinge parts detract from the external appearance of the vehicle and also expose the hinge parts to the environmental elements and increase the risk of physical damage to the hinge.

Another hinge providing for 180° of rotation is disclosed in U.S. Pat. No. 3,470,579. That hinge, however, is not particularly suited for use in a vehicle application and further requires a complex multiple lever arrangement including numerous pins, slots and cam surfaces which is both structurally and operationally complex.

SUMMARY OF THE INVENTION

According to the invention there is provided a door hinge that includes a pair of mounting brackets for attachment to the vehicle body and to the door. An intermediate member interconnects the two mounting brackets. The mounting brackets and intermediate member include means for releasably locking the respective brackets to the intermediate member and provides for sequential pivotable motion of the door about two different pivot points, one associated with the body mounting bracket and a second associated with the door mounting bracket.

According to a preferred embodiment of the invention, an elongated locking member is pivotably attached at a central location to the intermediate member and includes a first locking tab normally disengaged from a first slot in the body mounting bracket in the closed position providing for pivotable motion of the intermediate member about an axis on the body mounting bracket.

According to another feature of the invention, the pivotable lock member includes a second locking tab normally engaged in a slot in the door mounting bracket in the closed position providing for pivotable movement of the door mounting bracket and intermediate member as a unit about a first pivot pin on the body mounting bracket to which the intermediate member is affixed and which defines the pivotable axis on the body mounting bracket.

A still further feature of the invention provides for the second locking tab to index with the slot in the body mounting bracket at a partially open position of the door. A spring causes the lock member to pivot in a direction to simultaneously cause the first locking tab to engage into the slot in the body mounting bracket and the second locking tab to disengage from the slot in the door mounting bracket, thereby locking the intermediate member to the body mounting bracket and allowing the door mounting bracket to pivot independently about a second pivot pin which connects the door mounting bracket to the intermediate member and which defines a second pivotable axis.

BRIEF DESCRIPTION OF THE DRAWINGS

The invention will be better understood after a reading of the following detailed description of the preferred embodiment in conjunction with the drawings in which.

DETAILED DESCRIPTION OF THE PREFERRED EMBODIMENT

Figure 1:
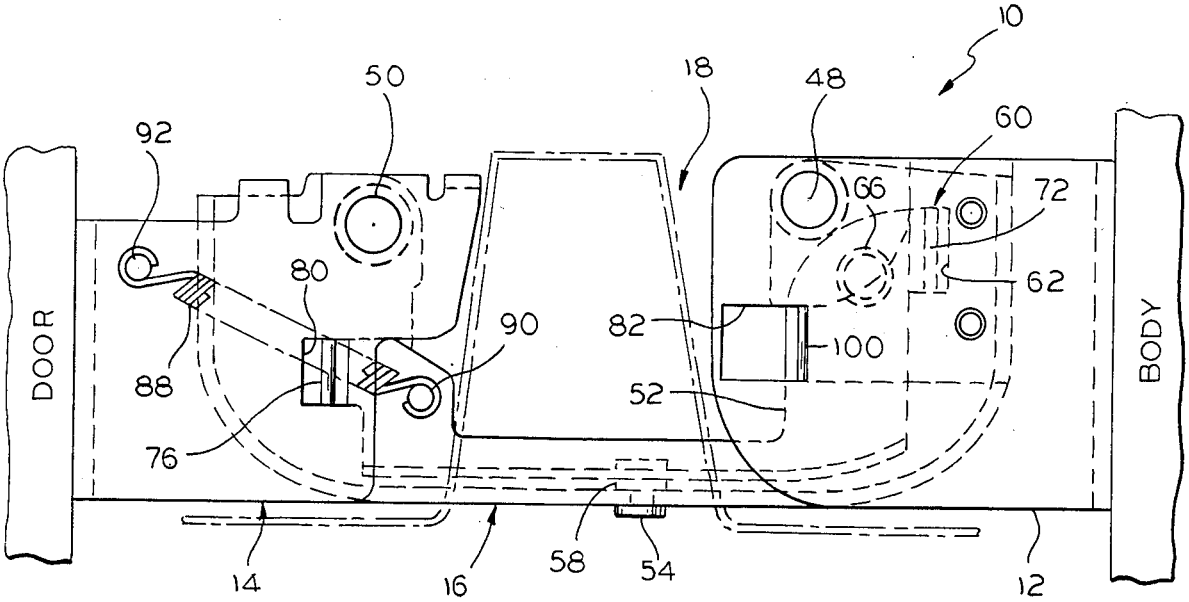
FIG. 1 is a top view of the hinge in the fully closed position showing details of construction and operation.
Figure 2:
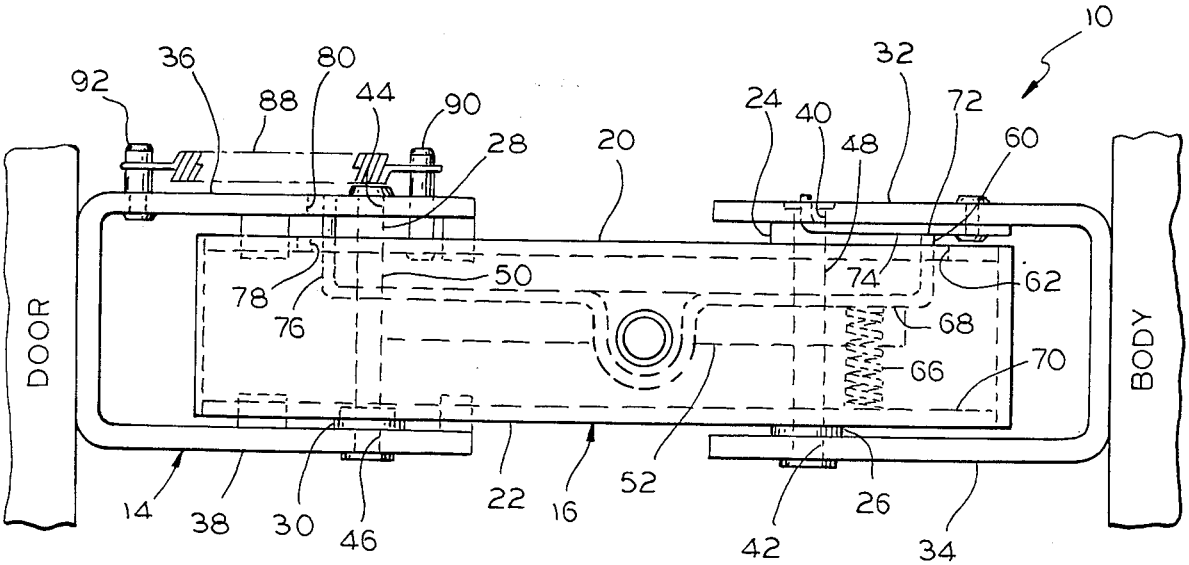
FIG. 2 is a side view of the hinge of FIG. 1 showing further details of construction and its operation.
Figure 6:
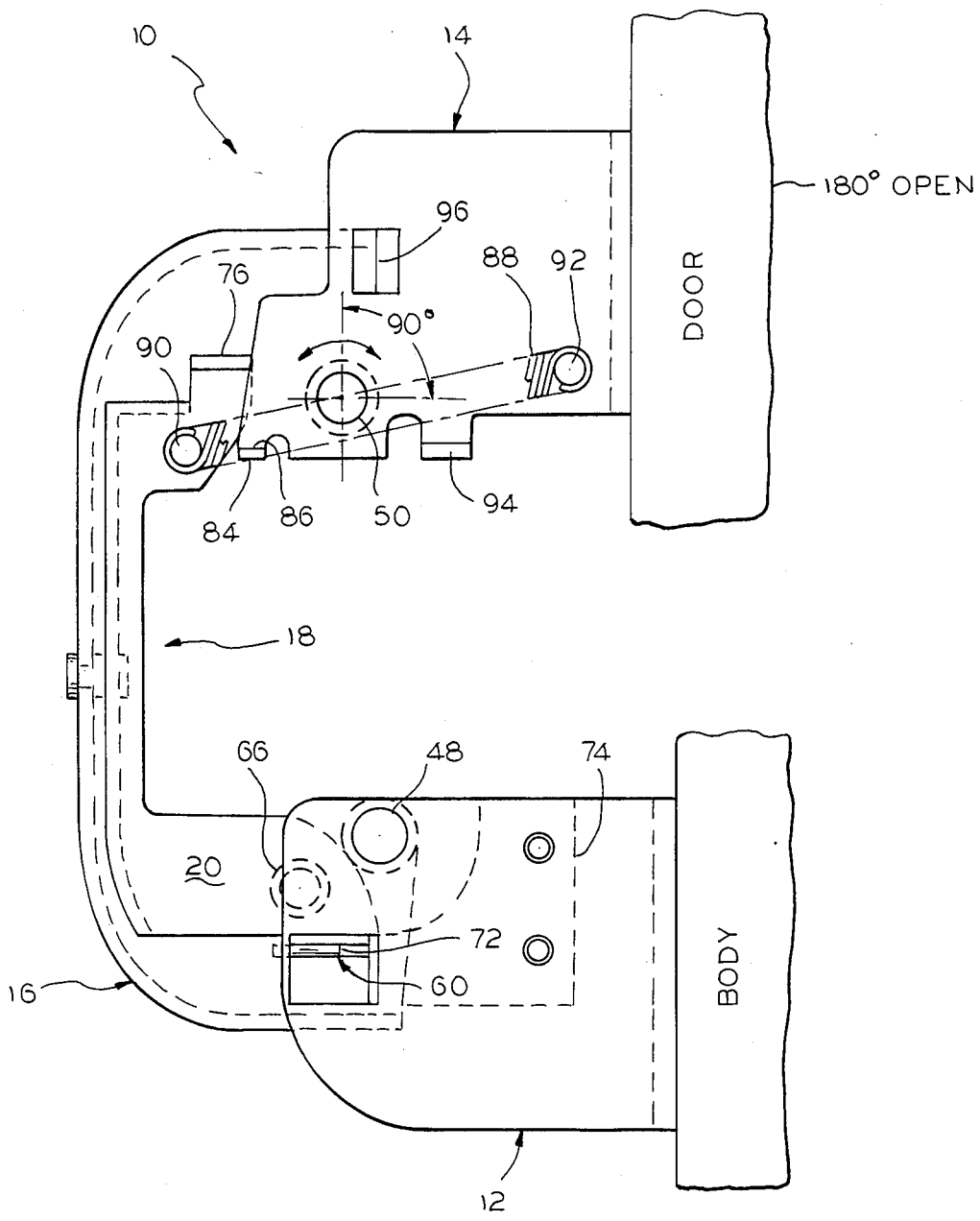
FIG. 6 is a top view of the hinge in the 180° fully open position showing details of construction and operation.

Referring to FIGS. 1 and 2, there is shown a door hinge 10 including a generally c-shaped body mounting bracket 12 and a c-shaped door mounting bracket 14. The body and door brackets are provided with means for attachment to a vehicle body and door, shown in broken away form, to be pivoted between a fully closed position, as shown in FIGS. 1 and 2, and a fully 180° open position, as shown in FIG. 6.

An intermediate member 16 in the form of a five sided c-shape member open along an exterior side 18 relative to the vehicle body interconnects the body and door mounting brackets 12, 14. The top and bottom portions 20, 22 of the intermediate member are provided with two pair of aligned spaced apart holes each including a bushing 24, 26, 28, 30. The respective top and bottom portions 32, 34, 36, 38 of the body and door mounting brackets are each provided with aligned clearance holes 40, 42, 44, 46. A pivot pin 48 is affixed in the aligned holes 40, 42 in the body mounting bracket 12 such as for example by press fitting. The pin 48 extends through the bracket and is journaled for rotation in the bushings 24, 26. A second pivot pin 50 is likewise affixed in the holes 44, 46 in the door mounting bracket and is journaled for rotation in the bushing 28, 30 in the intermediate member. The first pin 48 defines one pivotable axis about which the intermediate member 16 can pivot and the second pin 50 defines a second pivotable axis about which the door mounting bracket 14 can pivot.

Figures 3, 4:
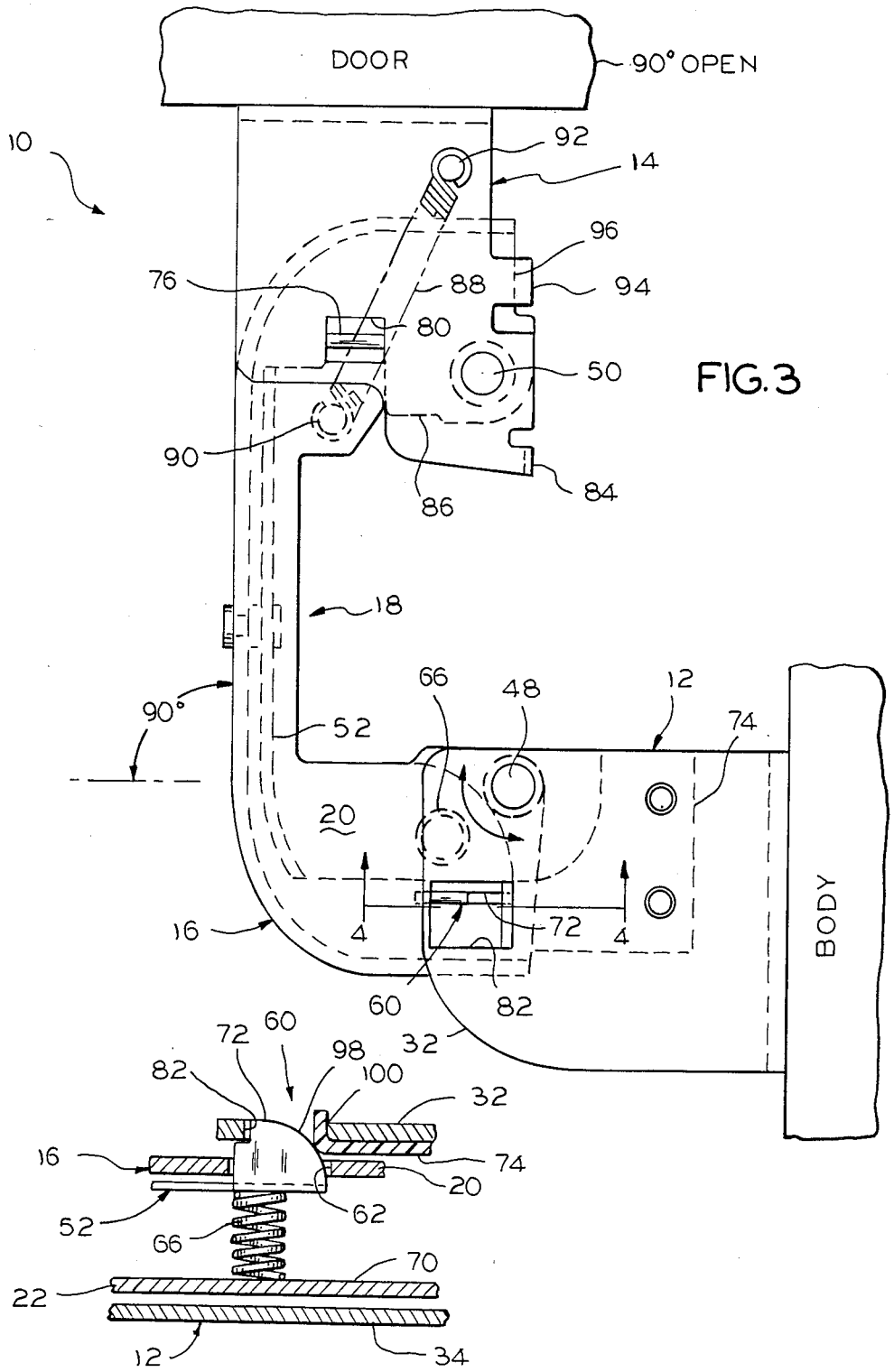
FIG. 3 is a top view of the hinge embodying the principles of the invention in a 90° partially open position showing details of construction and operation.
FIG. 4 is a partial cross sectional view taken along the line 4—4 in FIG. 3 showing details of construction and operation of the intermediate member to body bracket releaseable locking tab on the intermediate member.

As shown in the drawings, an elongated locking arm 52 is disposed int he interior of the c-shaped intermediate member 16 and is pivotably attached to the interior surface of the vertical, relative to the vehicle body, sidewall 54 of the intermediate member generally at its mid point by way of a pin 54 and bushing 58. The end of the locking arm at the body bracket is up-turned forming a first locking tab 60, the details of which are shown in FIG. 4, which aligns with a clearance slot 62 provided in the top wall 20 of the intermediate member 16. A compression spring 66 is supported between the bottom surface 68 of the locking arm 52 and the bottom interior surface 70 of the intermediate member lower portion 22 below the tab 60 and biases the locking arm upwardly. In the closed position of the door, as shown in FIGS. 1 and 2, the locking tab 60 is biased by the spring 66 through the slot 62 in the intermediate member and the free 72 end of the locking tab 60 engages against a wear plate 74 provided on the interior surface of the top portion 32 of the body mounting bracket. The wear plate 74, which can be of any of the well known minimum friction materials, provides for slidable movement of the free end 72 of the locking tab as the intermediate member 16 and locking arm 52 are pivoted about the pivot pin 48 from the closed position of FIG. 1 to an intermediate open position of FIG. 3 as described hereinbelow.

The other end of the locking arm also is provided with an up-turned portion forming a second locking tab 76 that in the closed position of the door (FIGS. 1 and 2) extends through an aligned slot 78 in the top portion 20 of the intermediate member 16 and engages into an aligned slot or opening 80 in the top portion 36 of the door mounting bracket 14. It can be seen that the intermediate member 16 is thereby locked in the closed position of the door to the door bracket 14 and that, therefore, the door bracket 14 and intermediate member 16 rotate as a single unit about the first pin 48 associated with the body bracket 12.

Referring principally to FIGS. 1, 3 and 4 the top member 32 of the body mounting bracket 12 is provided with a slot or opening 82 positioned, orientated and shaped to receive the locking tab 60 on the locking arm with the intermediate member in the intermediate, partially open position as shown in FIG. 3. The partially open position is preferrably at a 90° position of the intermediate member relative to the surface of the vehicle. In this intermediate position the locking tab 60 indexes with the slot 82 and due to the force of the compression spring 66 engages into the slot 82 thereby locking the intermediate member to the body bracket 12. Simultaneously, the pivotable movement of the locking arm 52 causes the second locking tab 76 to disengage from the slot 80 in the door mounting bracket 14. It can be seen that the simultaneous locking of the intermediate member to the body bracket and releasing of the intermediate member from the door bracket at the intermediate open position shown in FIG. 3 allows the door mounting bracket (and door) to pivot about the second pivot pin 50 from the intermediate open position to the fully 180° open position shown in FIG. 6.

Figure 5:
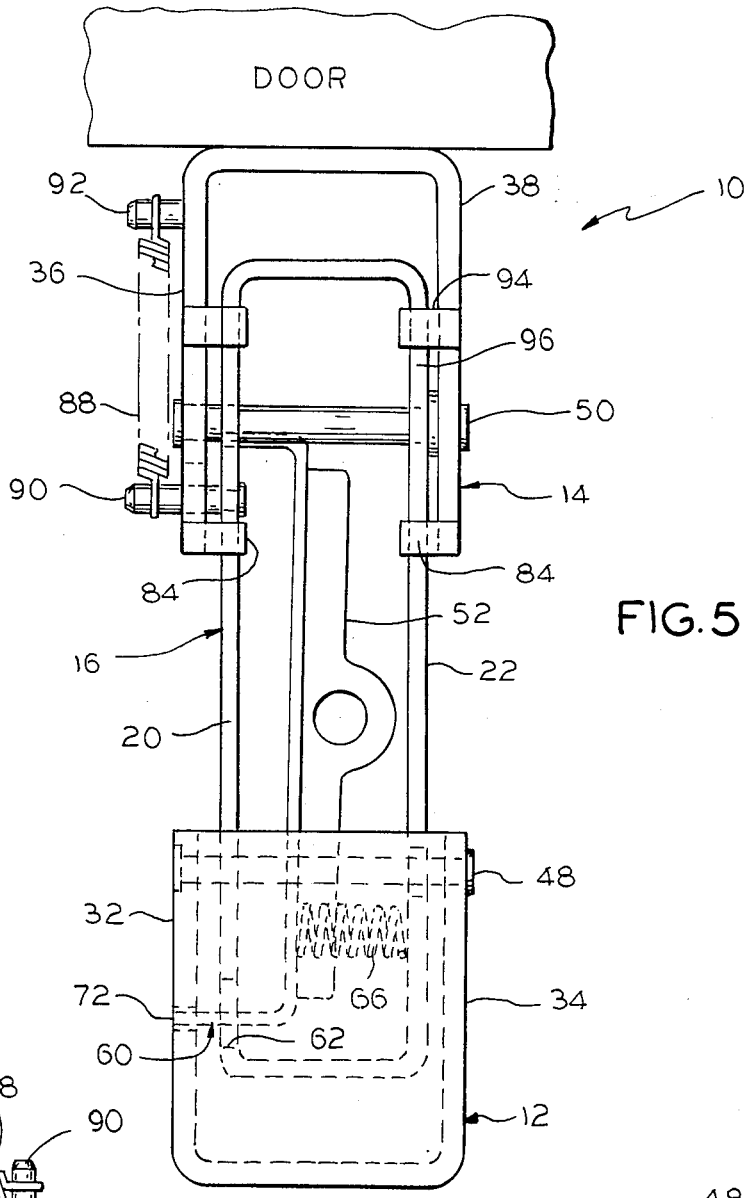
FIG. 5 is a side view of the hinge of FIG. 3 in the 90° partially open position showing futher details of construction and operation.
Figure 7:
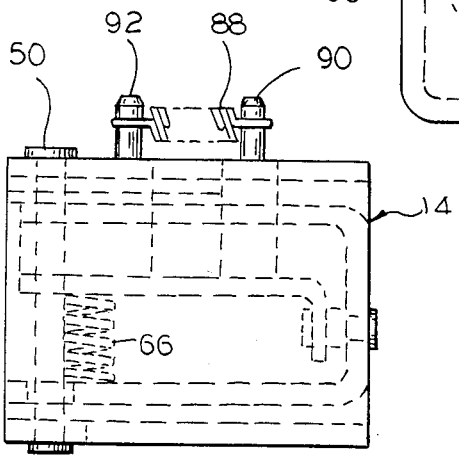
FIG. 7 is an end view as viewed toward the door mounting bracket of the hinge according to FIGS. 1 and 2 showing additional details of construction.
Figure 8:
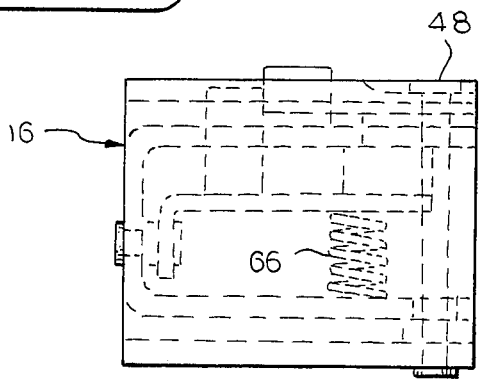
FIG. 8 is an end view of as viewed toward the body mounting bracket of the hinge according to FIGS. 1 and 2 showing further details of construction.

As shown in FIGS. 3, 5 and 6, at least one first stop 84 on the door mounting bracket contacts the exposed edge 86 of the intermediate member 16 in the fully opened position, and an extension spring 88 extends between a pair of pins 90, 92 on the intermediate member door mounting bracket respectively and functions to extend and exert a force on the door mounting bracket in a direction tending to move the door bracket toward the fully open position so as to both assist in moving the door from the intermediate open position to the fully opened position and to provide some degree of resilient retention of the door against unexpected, sudden movement of the door back to the partially opened or closed positions due to, for example, sudden wind gust. As stated, the first check or partially opened position is preferrably at 90° but can, if desired, be some other intermediate position.

As also shown best in FIGS. 3, 5 and 6 there is a return stop member 94 on the door mounting bracket which hits another exposed edge 96 of the intermediate member during its return motion from the fully opened to the intermediate position. The stop 94 contacts the intermediate member at the first check or 90° position (FIG. 3) and begins to force the intermediate member towards the closed position (counter-clockwise in FIG. 3). As shown in FIG. 4, the first locking tab 60 on the locking arm 52 is provided with a cam surface 98 which is abutted against a turned up portion 100 of the wear plate 74 at the edge of the slot 82 in the body bracket 12. As the intermediate member is forced towards the closed position due to the closure stop 94 being operator forced against the intermediate member, the cam surface 98 rides on the edge of the slot over the wear surface 100 and causes the intermediate member to pivot clockwise, as viewed in FIG. 2, causing the first locking tab 60 to disengage from the slot 82 in the body mounting bracket against the force of the spring 66 As the locking tab 60 and its end of the locking arm 52 pivot, the other end of the locking arm and its locking tab 76 also pivot about the pin 54 and bushing 58 and this movement causes the second locking tab 76 to reengage into the slot 80 in the door mounting bracket 14, thereby simultaneously affixing the door bracket to the intermediate member and releasing the intermediate member from the body bracket so that the intermediate member and door mounting bracket may again pivot as a unit back to the closed position about the first pivot pin 48.

Having described the preferred embodiment of the invention, those skilled in the art having the benefit of that description and the accompanying drawings can readily devise other embodiments and modifications and those other embodiments and modifications are therefore to be considered to be within the scope of the appended claims.

What is claimed is:

1. A hinge comprising:

a first mounting bracket adapted to be fixed to a support body and a second mounting bracket adapted to be fixed to a door;

an intermediate member, one end of the intermediate member being pivotably mounted to said first mounting bracket for relative rotation about a first pivot axis and the other end of the intermediate member being pivotably mounted to said second mounting bracket for relative rotation about a second pivot axis; and locking means for locking said intermediate member to said second mounting bracket when said intermediate member pivots about said first pivot axis between a closed position and an intermediate position and for locking said intermediate member to said first mounting bracket when said second mounting bracket pivots about said second pivot axis between the intermediate position and a fully open position, said locking means having releasing means for unlocking said intermediate member from the mounting bracket to which it is locked at the intermediate position whereby said intermediate member and said second mounting bracket can pivot about the first pivot axis between the closed and intermediate position and the second mounting bracket can pivot about the second pivot axis between the intermediate and fully open positions.

2. The hinge as defined in claim 1 wherein said locking means comprises:

a locking arm having opposing ends, said locking arm being pivotably mounted to said intermediate member at a point proximate a central location between said opposing ends whereby said opposing ends can pivot about said point;

first slot means in said first mounting bracket;

second slot means in said second mounting bracket;

a first locking tab on one of said opposing ends of said locking arm;

a second locking tab on a second of said opposing ends of said locking arm;

said locking means including means for pivoting said locking arm to engage said first locking tab into said first slot means and to simultaneously disengage said second locking tab from said second slot means at the intermediate open position during movement of said second mounting member and said intermediate member from the closed position toward the open position; and said releasing means including means providing for disengagement of said first locking tab from said first slot means and simultaneous engagement of said second locking tab into said second slot means at the intermediate open position during movement of said second mounting member from the fully opened position toward the closed position.

3. The hinge as deined in the claim 2, wherein said means for pivoting includes first spring means for biasing said locking arm.

4. The hinge as defined in claim 3, wherein said first spring means normally biases said locking arm in a first direction for engaging said first locking tab into said first slot means, said means for disengagement includes a cam surface on said first locking tab, said cam surface engaged against an edge of said first slot means in the intermediate open position with said first locking tab received in said first slot means, and means on said second mounting member for forcing the cam surface against the edge of said first slot means during movement of said intermediate from the intermediate open position toward said closed position said cam surface riding on said edge during an initial portion of the movement of said second mounting member from the intermediate open position toward the closed position causing said locking arm to pivot in a second direction for disengaging said first locking tab from said first slot means and simultaneously engaging said second locking tab in said second slot means.

5. The hinge as defined in claim 4, wherein said means for forcing the cam surface against said edge of said first slot means includes a closure stop member on said second bracket member engaging said intermediate member in the intermediate open position.

6. The hinge as defined in claim 5, further including a fully open position stop member on said second bracket member engaging said intermediate member in the fully opened position.

7. The hinge as defined in claim 4 further including second spring means associated with said second bracket member providing for creating a bias force on said second bracket member acting in the direction of movement toward the fully opened position with said second bracket member at any location between the intermediate open position and the fully opened position.

8. The hinge as defined in claim 7, wherein said second spring means is an extension spring affixed at one end to said second bracket member and at a second end to said intermediate member.

9. A hinge comprising:

a first mounting bracket adapted to be affixed to a mounting member;

a second mounting bracket adapted to be affixed to a door;

an intermediate member pivotably connected to said first mounting bracket at a first pivot point and pivotably connected to said second mounting bracket at a second pivot point; and, means for sequentially releasably locking said second mounting bracket to said intermediate member against relative pivotal movement about said second pivot point and simultaneously providing for pivotal movement of said intermediate member about said first pivot point between a closed position of said door and a predetermined intermediate open position of said door and for releaseably locking said intermediate member to said first mounting bracket against pivotable movement about said first pivot point and simultaneously unlocking said second mounting bracket from said intermediate member at said predetermined intermediate open position providing for pivotable movement of said second mounting bracket about said second pivot point between said predetermined intermediate open position of said door and a fully opened position of said door.

* * * * *